United States Patent [19]

Wirtz et al.

[11] Patent Number: 4,928,903

[45] Date of Patent: May 29, 1990

[54] PALLET FOR TRANSPORTING COPS

[75] Inventors: Ulrich Wirtz; Dietmar Engelhardt, both of Mönchengladbach, Fed. Rep. of Germany

[73] Assignee: W. Schlafhorst & Co., Mönchengladbach, Fed. Rep. of Germany

[21] Appl. No.: 415,062

[22] Filed: Sep. 29, 1989

[30] Foreign Application Priority Data

Sep. 30, 1988 [DE] Fed. Rep. of Germany ..... 3833259

[51] Int. Cl.[5] ..... B65H 49/00; B65H 49/38

[52] U.S. Cl. ..... 242/130; 242/35.5 A; 242/35.6 E

[58] Field of Search ..... 242/130, 130.3, 130.4, 242/129.5, 35.5 A, 35.6 R, 35.6 E, 18 R

[56] References Cited

U.S. PATENT DOCUMENTS

| | | | |
|---|---|---|---|
| 1,966,247 | 7/1934 | Janssen | 242/130.3 |
| 2,297,667 | 9/1942 | Winslow | 242/130.3 |
| 3,294,352 | 12/1966 | Leonard | 242/130.3 X |
| 4,463,909 | 8/1984 | Kiriake et al. | 242/35.5 A |
| 4,601,434 | 7/1986 | Mori et al. | 242/35.5 A |

FOREIGN PATENT DOCUMENTS

| | | |
|---|---|---|
| 1760689 | 2/1972 | Fed. Rep. of Germany . |
| 3249583 | 1/1986 | Fed. Rep. of Germany . |

*Primary Examiner*—Stanley N. Gilreath

*Attorney, Agent, or Firm*—Herbert L. Lerner; Laurence A. Greenberg

[57] ABSTRACT

A pallet for transporting cops includes a disk-like base plate. A creel spindle is disposed on the base plate for holding a cop haivng a cop tube with a tube bottom and an open interior. A base supports the tube bottom. The base is interrupted at least one point to form an air duct extending into the open interior of the cop tube for guiding an air flow through the cop tube.

5 Claims, 4 Drawing Sheets

PALLET FOR TRANSPORTING COPS

The invention relates to a pallet for transporting cops, which has a disk-like base plate, a creel spindle for holding a cop and an air duct for guiding an air flow through the cop tube.

Pallets having a disk-like base plate and a creel spindle for holding a yarn bobbin are already known from German Published, Non-Prosecuted Application DE-OS 17 60 689. As a further development of that prior art, German Patent DE-PS 32 49 583 describes a pallet of that kind which has a vertical bore therethrough extending from the top of the creel spindle to the underside of the base plate. The bore makes it possible to blow air from the underside of the pallet into the cop tube, or to aspirate air from the cop tube. Transmission of these air flows is necessary not only to aspirate the beginning of the yarn into the interior of the cop tube in order to prepare the cop for a spooling frame, but also to blow the beginning of the yarn out of the cop tube again at the spooling station. However, the bores of the prior art have poor properties because they permit dirt to enter into and collect in the air duct and because they cannot be used on a conveyor belt.

It is accordingly an object of the invention to provide a pallet for transporting cops, which overcomes the hereinafore-mentioned disadvantages of the heretofore-known devices of this general type and which has good properties both in the transport area and in the operating position during processing of the cop.

With the foregoing and other objects in view there is provided, in accordance with the invention, a pallet for transporting cops, comprising a disk-like base plate, a creel spindle disposed on the base plate for holding a cop having a cop tube with a tube bottom and an open interior, and a base for supporting the tube bottom, the base being interrupted at least at one point to form an air duct extending into the open interior of the cop tube for guiding an air flow through the cop tube.

An advantage of these features is that when the pallet is being transported on a conveyor belt, dirt can no longer get into the air duct and collect there, because the base plate is closed. Thus even if a pallet remains on the moving conveyor belt for a relatively long time, there is no longer the danger that the collected dirt will be blown with the air through the cop tube into the spooling frame in the operating position. With the pallet according to the invention, the air is fed through an air duct that is created at the interruption of the base on which the bottom of the tube stands. This brings the further advantage that with processing equipment at which the beginning of the yarn is blown into the interior of the tube of the cop from above, for instance, the air can escape from the lateral air duct even while the pallet is on the conveyor belt. Accordingly it is not necessary to remove the pallet from the conveyor belt and to set it over an air outlet opening for this operation.

In accordance with another feature of the invention, the creel spindle has an outer periphery along which the air duct extends into the open interior of the cop tube.

In accordance with a further feature of the invention, the pallet has a vertical central axis, and the creel spindle is formed of at least three ribs disposed equidistantly about the central axis of the pallet, the ribs having outer surfaces with shoulders formed therein at a uniform distance above the base plate forming the interrupted base for the tube bottom.

In accordance with an added feature of the invention, the ribs are interconnected in the vicinity of the central axis of the pallet.

In accordance with a concomitant feature of the invention, the ribs have recesses formed therein between the shoulders and the base plate.

Other features which are considered as characteristic for the invention are set forth in the appended claims.

Although the invention is illustrated and described herein as embodied in a pallet for transporting cops, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
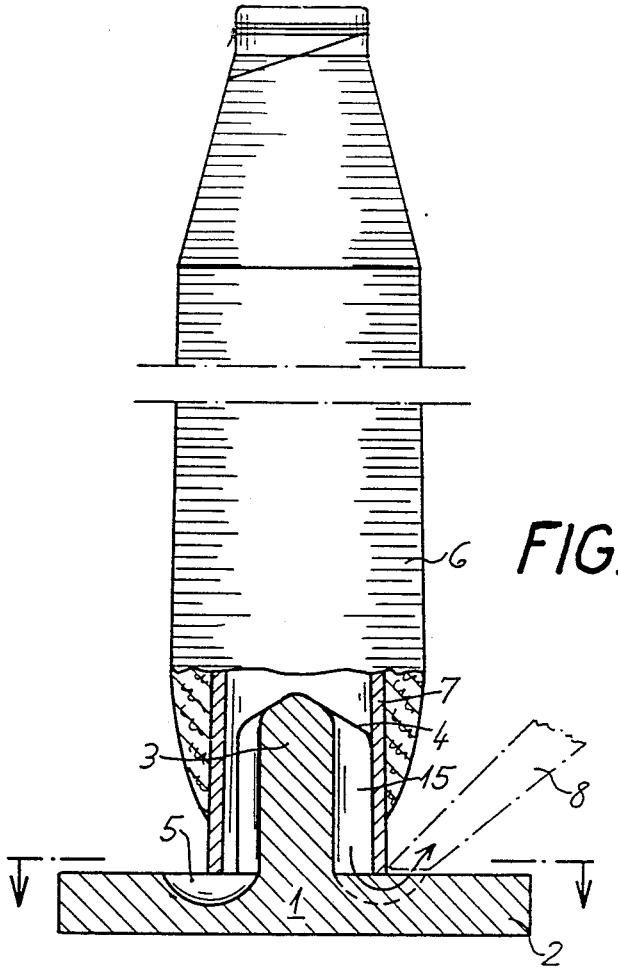
FIG. 1 is a fragmentary, diagrammatic, side-elevational view of a pallet according to the invention with a cop mounted thereon and bowl-shaped air ducts, which is taken along the arrows in FIG. 2 and is partly broken-away in a longitudinal-section.
Figure 2:
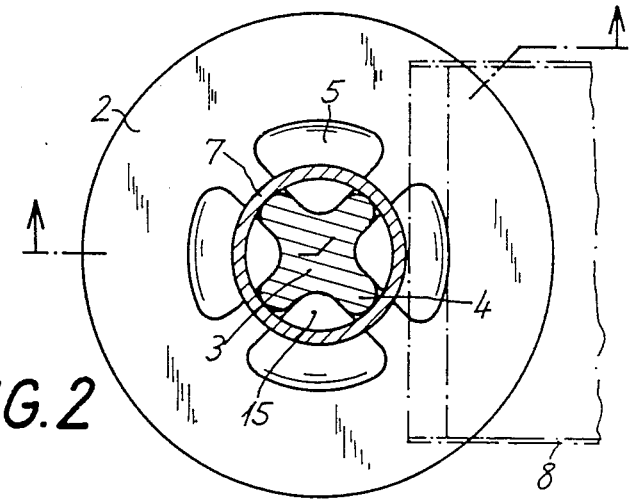
FIG. 2 is a cross-sectional view of the pallet taken along the arrows in FIG. 1.

Referring now to the figures of the drawing in detail and first, particularly, to FIG. 1 thereof, there is seen a creel spindle 3 of a pallet 1 which is formed of four ribs 4. Vertical channels 15 which are formed between the ribs 4 and a cop tube 7 in a cop 6, discharge into bowl-shaped depressions 5 formed in the base plate 2 of the pallet 1. The cop 6 stands with the bottom of the tube 7 on the base plate 2 between the depressions 5. As a result, the bottom of the tube 7 is spaced apart from the base plate in the vicinity of the depressions 5 and forms air ducts. The tube bottom is accordingly supported by a base which is interrupted to form an air duct 8, 5, 15 extending into the open interior of the cop tube 7 for guiding an air flow through the cop tube 7. The configuration of the depressions 5 is particularly readily seen in FIG. 2. A suction nozzle 8 which is also shown in phantom in FIGS. 1 and 2, can transport the beginning of the yarn in the interior of the tube, for instance at a cop preparation station. When the pallet 1 is carried past the suction nozzle 8, the front edge of the suction nozzle aligns the pallet in such a way that the air can be aspirated through one of the four channels 15. Since the vertical channels 15 between the ribs 4 do not communicate with one another, the suction flow is largely transmitted into the interior of the cop tube. This assures that the aspiration of the beginning of the yarn can take place whenever the cop 6 with the pallet 1 is being transported.

Figure 3:
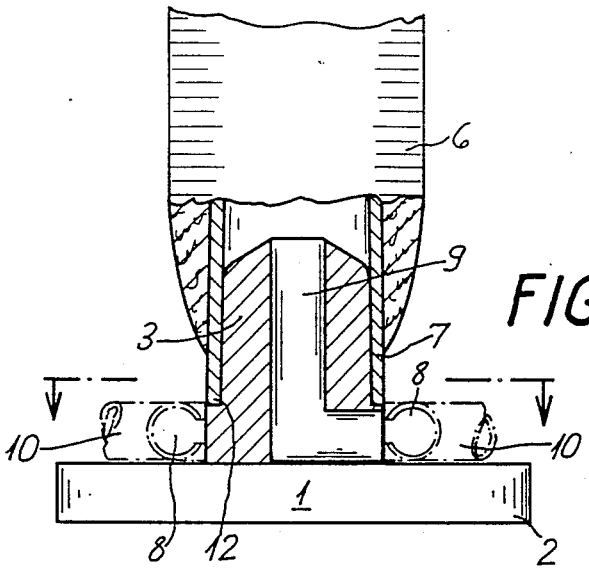
FIG. 3 is a view similar to the lower portion of FIG. 1 of a pallet according to the invention with a bore which is bent at an angle and passes through a creel spindle, which is taken along the arrows in FIG. 4.
Figure 4:
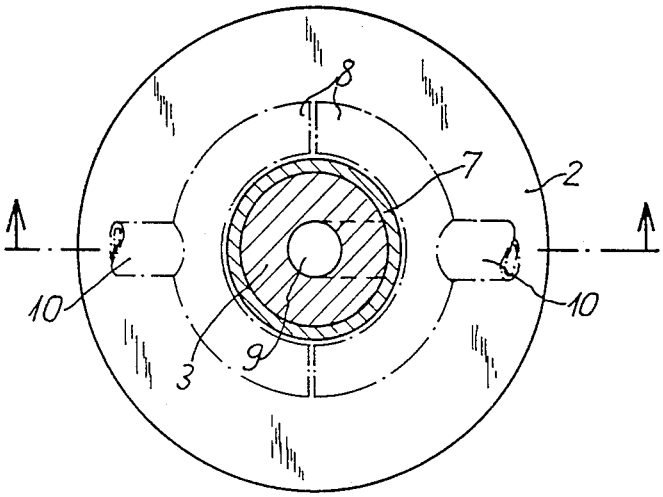
FIG. 4 is a cross-sectional view of the pallet taken along the arrows in FIG. 3.

In another embodiment, which is shown in FIGS. 3 and 4, the creel spindle 3 has a bore 9 which is bent at an angle. Since it cannot be assured that the horizontal portion of the bore 9 will point in a particular direction when the pallets are being transported, semicircular suction nozzles 8 are provided for this embodiment. These suction nozzles 8 may, for example, communicate with clamping prisms, so that they close around the creel spindle 3 above the base plate 2 during cop preparation. These suction nozzles 8 communicate through suction tubes 10 with a negative pressure system. An annular shoulder 12 of the creel spindle 3 prevents the cop 6 from being able to slide down onto the base plate 2 over the creel spindle 3 and therefore from being able to close the bore 9. The tube bottom is accordingly supported by a base which is interrupted to form an air duct 8, 9 extending into the open interior of the cop tube 7 for guiding an air flow through the cop tube 7.

Figure 5:
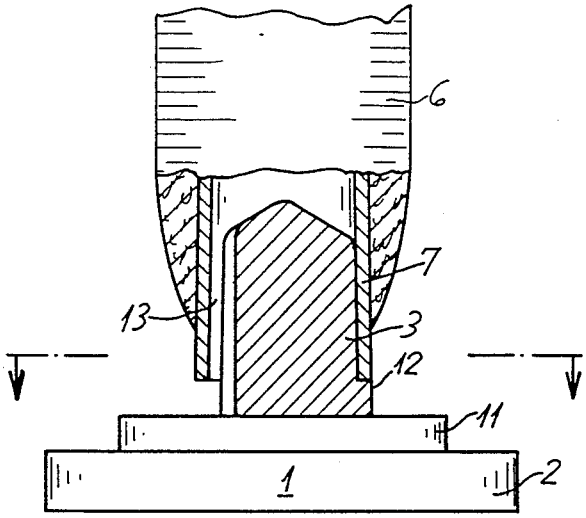
FIG. 5 is a view similar to FIG. 3 of a pallet according to the invention in which the creel spindle has a shoulder and a vertical recess, which is taken along the arrows in FIG. 6.
Figure 6:
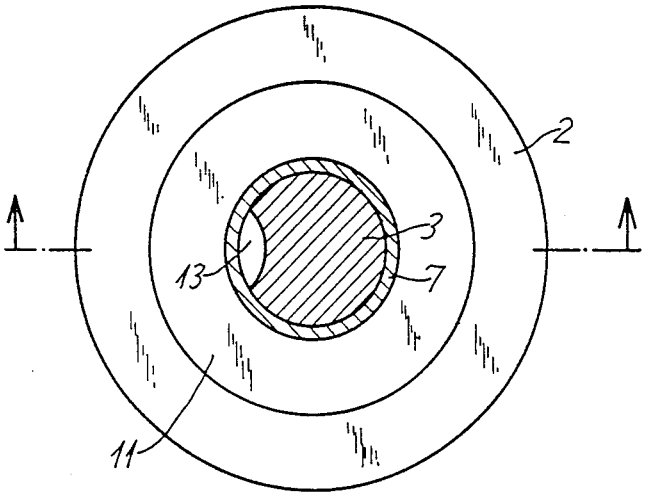
FIG. 6 is a cross-sectional view of the pallet taken along the arrows in FIG. 5.

In a further variant of the invention, which is shown in FIGS. 5 and 6, the creel spindle has a vertical recess 13, which continues as far as a pallet neck 11. In this embodiment as well, a closure of the opening formed by the recess 13 above the pallet neck 11 is prevented by a shoulder 12. The tube bottom is accordingly supported by a base which is interrupted to form an air duct 13 extending into the open interior of the cop tube 7 for guiding an air flow through the cop tube 7. This variant is, for instance, particularly suitable if the beginning of the yarn is blown from above into the interior of the cop tube 7 at a cop preparation station. The recess 13 prevents the creation of an air dam. The pallet neck 11 may, for instance, be used for guiding the pallet 1 in the conveyor system.

Figure 7:
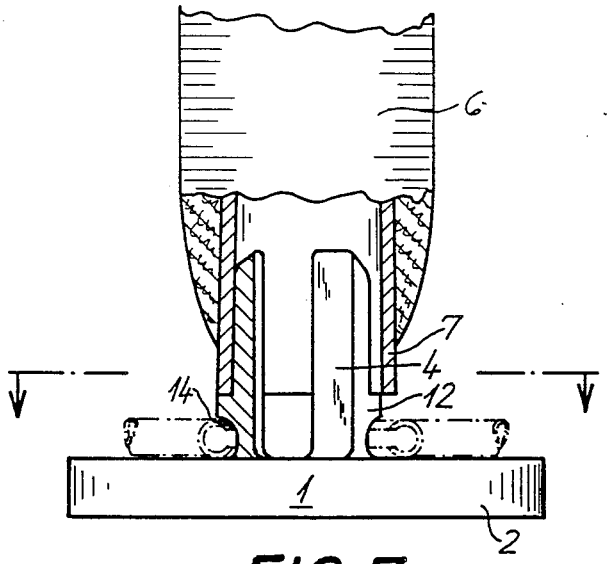
FIG. 7 is another view similar to FIG. 3 of a pallet according to an invention in which the creel spindle is formed of ribs, which is taken along the arrows in FIG. 8.
Figure 8:
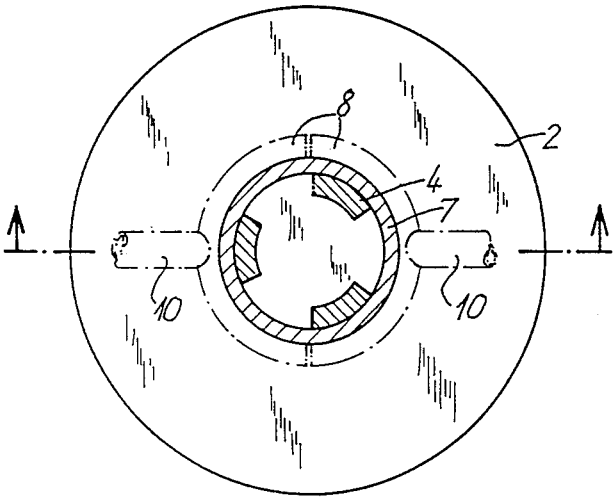
FIG. 8 is a cross-sectional view of the pallet taken along the arrows in FIG. 7.

The variant of the present invention shown in FIGS. 7 and 8 has a creel spindle formed from three ribs 4. Once again, shoulders 12 keep the cop 6 from sliding down onto the base plate 2. Recesses 14 beneath the shoulders 12 assure better contact of suction nozzles 8 which are also semicircular with suction tubes 10. The tube bottom is accordingly supported by a base which is interrupted to form an air duct 8, 14 extending into the open interior of the cop tube 7 for guiding an air flow through the cop tube 7. The relatively wide construction of the air ducts between the ribs 4 permits a particularly effective transmission of the air flows.

If there is an odd number of ribs 4, better coupled travel of the cop 6 is also secured when the pallet is rotated, for instance to receive the beginning of the yarn in cop preparation. In contrast to a full creel spindle which is unlikely to tilt, if the spindle is not full a slight tilting may occur which leads to point-like clamping.

Although the views shown in the drawings relate to suction nozzles applied to the air ducts, it is naturally within the scope of the invention to use blower nozzles instead, for instance in order to blow the beginning of the yarn out of the tube at the spooling frame.

We claim:

1. Pallet for transporting cops, comprising a disk-like base plate, a creel spindle disposed on said base plate for holding a cop having a cop tube with a tube bottom and an open interior, and a base for supporting the tube bottom, said base being interrupted at least at one point to form an air duct extending into the open interior of the cop tube for guiding an air flow through the cop tube.

2. Pallet according to claim 1, wherein said creel spindle has an outer periphery along which said air duct extends into the open interior of the cop tube.

3. Pallet according to claim 1, wherein the pallet has a vertical central axis, and said creel spindle is formed of at least three ribs disposed equidistantly about the central axis of the pallet, said ribs having outer surfaces with shoulders formed therein at a uniform distance above said base plate forming said interrupted base for the tube bottom.

4. Pallet according to claim 3, wherein said ribs are interconnected in the vicinity of the central axis of the pallet.

5. Pallet according to claim 3, wherein said ribs have recesses formed therein between said shoulders and said base plate.

* * * * *